United States Patent [19]

Voss

[11] Patent Number: 5,012,786

[45] Date of Patent: May 7, 1991

[54] DIESEL ENGINE FUEL INJECTION SYSTEM

[76] Inventor: James R. Voss, Six Eastwood Dr., Wilbraham, Mass. 01095

[21] Appl. No.: 490,341

[22] Filed: Mar. 8, 1990

[51] Int. Cl.[5] ..... F02M 41/00; F02M 7/00

[52] U.S. Cl. ..... 123/467; 123/447; 239/533.9

[58] Field of Search ..... 123/467, 447, 446, 496, 123/500, 501; 239/88-96, 533.9, 533.12

[56] References Cited

U.S. PATENT DOCUMENTS

| | | | |
|---|---|---|---|
| 3,416,506 | 12/1968 | Steiger | 123/467 |
| 3,810,453 | 5/1974 | Wolfe | 123/467 |
| 4,036,192 | 7/1977 | Nakayama | 123/467 |
| 4,167,168 | 9/1979 | Yamamoto | 123/467 |
| 4,403,585 | 9/1983 | Ohie | 239/533.9 |
| 4,437,443 | 3/1984 | Hofbauer | 123/467 |
| 4,513,719 | 4/1985 | Edo | 123/447 |
| 4,665,881 | 5/1987 | Wade | 123/447 |
| 4,830,285 | 5/1989 | Tanaka | 239/533.9 |
| 4,938,193 | 7/1990 | Raufeisen | 123/467 |
| 4,957,085 | 9/1990 | Sverdlin | 123/467 |

*Primary Examiner*—Carl Stuart Miller

*Attorney, Agent, or Firm*—McAndrews, Held & Malloy, Ltd.

[57] ABSTRACT

The diesel internal combustion engine fuel injection system includes an accumulator nozzle having its opening pressure close to its closing pressure so as to provide a high turn down ratio without excessive maximum charging pressure. The accumulator nozzle may include a displacement piston which is used to lower the charging pressure by a fixed amount after the injection of fuel into the engine cylinder commences. Alternatively, the accumulator nozzle may include a small moveable piston which serves to raise the closing pressure after the injection of fuel into the engine cylinder commences.

16 Claims, 5 Drawing Sheets

DIESEL ENGINE FUEL INJECTION SYSTEM

BACKGROUND OF THE INVENTION

This invention relates to a fuel injection system for a diesel internal combustion engine, and more particularly, to a diesel engine fuel injection system that utilizes accumulator nozzles, to inject diesel fuel into the engine cylinders and that employs a multiple pumping element or chamber jerk pump for providing the system with pressurized diesel fuel.

Jerk pump fuel injection systems for diesel engines are known. In such systems, each engine cylinder has its own pumping element. An inlet or fill port allows the inflow of fuel to the pumping chamber of the pump. Before ingress into the pumping chamber, the fuel is stored in a fuel gallery and is pre-pressurized, to about 50 psi, by a separate charging pump.

When the pressure of the fuel in the pumping chamber of the jerk pump is high enough, the pump's delivery valve opens and fuel passes into an injection line. The high pressure fuel from the pumping chamber presses against the fuel in the injection line causing a compressive wave to propagate down the injection line at a velocity of sound in fuel (approximately 5,000 feet per second).

A nozzle or ejector unit is located at the other end of the injection line, and in essence, closes that end of the line. The initial part of the compressive wave may be reflected at the nozzle back down the injection line toward the pump. The compressive wave pressure quickly builds up to a pressure required to open the nozzle. The open nozzle injects fuel into the engine combustion chamber through tiny orifices. Much of the fuel driven toward the nozzle by the compressive wave is injected into the engine combustion chamber in this manner. The match among the injection line internal diameter, the total nozzle orifice area and the pressure of the compressive wave determines the fraction of fuel that is reflected during the injection.

Referring back to the jerk pump, the pumping piston completes its mission by opening its spill port. As a result, fuel is dumped from the pumping chamber back into the fuel gallery. As the pressure in the pumping chamber drops, the delivery valve closes to prevent a back flow from the injection line. The compressive wave is no longer formed, and this lack of pressure is propagated to the nozzle, also at the speed of sound. When the pressure drops, the nozzle closes, ending the injection of fuel into the engine cylinder.

The function of the delivery valve in such fuel injection systems is important and complex. If the delivery valve were a "pure" check valve, those parts of the compressive wave that were reflected at the nozzle would be reflected again at the delivery valve. If this second reflection was strong enough, it could open the nozzle again when it arrives there. This "secondary" injection would occur too late to contribute to engine power but in time to partially burn. Such a late burn wastes fuel and forms excessive smoke even by standards existent before the recent emphasis on pollution control.

To prevent such a secondary injection, delivery valves generally include structure that permits a fixed amount of fuel to be by-passed back into the pumping chamber before the delivery valve is allowed to seal. As a result, the residual pressure in the injection line is brought close to zero between injections. It has been recognized that there are perhaps more disadvantages to the use of a delivery valve than advantages; yet their usage continues.

The time of the injection of fuel into the engine cylinders controls the timing of the heat release as the fuel burns. Before control of emissions became so important, the fuel was injected generally twenty degrees before the engine piston reached its top dead center. Pressure and temperature in the engine chamber is rapidly rising at this time, and fuel would have its combustion delayed until just before top dead center. As the cycle preceded past top dead center, the heat release was very fast, creating high pressures and temperatures at the peak of the stroke. Oxides of nitrogen ("NOx") were formed rapidly under these conditions, and even though the fuel had a relatively long time to burn, there was also significant smoke and particulates produced.

It is known that substantial reductions in NOx pollutants can be achieved, without much penalty in fuel consumption, if the timing is retarded to approximately five degrees before top dead center. However, such timing is now "on the edge". In other words, a little more retarding and the fuel consumption goes up quickly; a little less retarding, and the NOx pollution goes up quickly.

Because of the hydraulics of the jerk pump system, there is a natural retarding as the engine speed increases. This is caused by the fixed time that it takes for the pressure wave to travel down the injection line. Hence, to maintain optimal timing at all engine speeds, the current practice is to use timing devices such as, for example, of the type generally described in Berman and DeLuca, FUEL INJECTION AND CONTROLS FOR INTERNAL COMBUSTION ENGINES (Simmons-Boardman Publishing Corporation, 1962) at pages 166–168 ("Berman"). Others have, however, suggested electronically timed injection to optimize conditions for both engine load and speed.

Control of pollutants caused by the operation of diesel engines has and continues to be an important motivating factor in designing fuel injection systems for diesel engines. Pollutants fall into two general classes: one is the NOx's caused by allowing the combustion chamber's temperature to be too high for too long; and the other is in the form of smoke, particulates, carbon monoxide and odor that are formed by incomplete combustion. As noted above, the control of the timing of the fuel injection has been a primary means utilized to control NOx pollutants, with the conventional wisdom being that the later the start of the fuel injection, the lower the NOx pollutants. Unfortunately, later injection timing tends to decrease engine efficiency and to increase the other class of pollutants.

Under most conditions of steady state diesel engine combustion, there is plenty of air to burn the fuel. Incomplete combustion is caused by the fuel not vaporizing in time or the fuel vapor not getting mixed with the air in time. In the short time that combustion takes place, the smallest drops of fuel easily vaporize and complete their combustion. However, relatively larger drops take longer to complete this process, and it is these larger drops, particularly those formed by the low pressure end of the injection, that cause smoke, odor, carbon monoxide and particulate pollutants. In other words, it is only a small part of the injected fuel that leads the "incomplete combustion" class of pollutants.

From the standpoint of fuel injection system design, it has long been recognized that the larger drops of fuel are formed only when the pressure drop across the nozzle orifices is small. In the conventional jerk pump injection system, the latter condition exists as the nozzle needle valve attempts to close the orifices, that is, at the end of the injection cycle.

One proposed way of avoiding ending the injection with a low pressure drop is to raise the closing pressure at the nozzles. This has been done experimentally by applying a hydraulic back pressure to the nozzle needle valve from an external high pressure hydraulic source. This does minimize, to a certain extent, the incomplete combustion class of pollutants, but it is not practical in a working fuel injection system. More specifically, if the closing pressure is raised in a conventional system, the opening pressure is also raised and at cranking speeds, the injection pump cannot raise the pressure of the fuel sufficiently high.

It has been proposed to use accumulator nozzles to inject the fuel in the engine cylinders since such nozzles can be employed to avoid low pressure injection. In an accumulator nozzle, the fuel injection starts at full charging pressure. The nozzle injection pressure drops continuously until it reaches the nozzle closing pressure. The nozzle closes at that pressure such that at no time is fuel injected at a lower pressure. Accordingly, the use of accumulator nozzles with a conventional fuel injection system should theoretically yield less smoke, particulates, carbon monoxide, and odor than do other conventional nozzles. Unfortunately, the accumulator nozzle has opening pressure limitations during engine cranking like those of conventional nozzles.

The use of an accumulator nozzle also has other possible advantages in that it allows a simple method of timing the injection as compared with other conventional injection nozzles. Specifically, the accumulator nozzle does not inject while its accumulator volume is being charged. The injection starts only when the pressure in the injection line is reduced. This can be delayed after the charging is complete without difficulty. For example, if the charging pump completes its charging function and is then isolated from the injection line by, for example, a simple check valve, the injection line pressure can thereafter be reduced by a secondary or spill valve at a time not related to the charging process. If this secondary valve is controlled electronically, all the flexibility of electronic timing can be used to also reduce the other pollutants, that is, the NOx's. Alternatively, the secondary valve may be controlled mechanically by a timing device which is dependent on engine speed and which will advance the injection at higher speeds to obtain an optimum pollutants/fuel consumption relationship.

Because of the evident advantages of accumulator nozzles in diesel engine fuel injection systems, those working in the art have attempted to solve the opening pressure limitations during engine cranking noted above. In this regard and as noted, it has long been recognized that the final injection pressure should be as high as possible. This, of course, can be accomplished by raising the closing pressure of the accumulator nozzle.

Although the conventional jerk pumps have no difficulty in supplying high pressure fuel under normal operating conditions, such pumps, as noted, are often not able to supply high pressure while the engine is cranking. If the closing pressure is held constant, it is limited by the requirement that the fuel injection system be able to start the engine under all conditions. In this regard, it has been recognized that the closing pressure may be very low, under engine starting conditions, and may be raised to a higher value, under engine running conditions, by imposing a back pressure in the chamber whose pressure controls the opening of the nozzle needle valve of the accumulator nozzle. This can be done by regulating the pressure of the sump into which the timing or secondary valve spills. Under this arrangement, the back pressure would be approximately zero while the engine was being cranked because there would not be enough spill flow to raise the pressure. After the engine is running for a short time, the back pressure in the chamber will rise. Thus, the opening pressure (and closing pressure) can be very low for easy starting and the closing pressure can thereafter be raised to a higher value for reduced incomplete combustion pollutants under running condition.

There is, however, one serious problem that has long been recognized with regard to the use of accumulator nozzles in diesel engine fuel injection systems and that, as a practical matter, has prevented the usage of accumulator nozzles (as opposed to more complicated and expensive injector units that include accumulator nozzles as a component part) in such systems. Specifically, the accumulator nozzle that can deliver a certain maximum fuel charge or quantity of fuel has difficulty delivering a small enough charge or quantity to allow the engine to idle satisfactorily. The quantity of fuel discharged may be given by the following relationship:

$$q = V/K(P_1 - P_2)$$

Where "q" is equal to the discharged quantity in cubic millimeters; "V" is equal to the volume of the accumulator in cubic millimeters; "K" is equal to the bulk modulus of fuel, for example 280,000 psi; "$P_1$" is equal to the peak accumulator pressure in psi; and "$P_2$" is equal to the nozzle closing pressure in psi.

The ratio of the maximum fuel charge delivered to the minimum fuel charge delivered is called the "turn down ratio." The art has recognized that engines need a turn down ratio of at least 8 and preferably 10.

The injected quantity fuel is stored in the compressibility of the fuel in the accumulator volume. As already stated, the quantity of fuel delivered is proportional to the pressure difference between the starting pressure and the closing pressure. The minimum delivery occurs when the charging pressure $P_1$ is just enough to open the nozzle, that is, just greater than the opening pressure. The minimum delivery is proportional to the opening and closing pressure difference, e.g., 1,000 to 1,500 psi. To obtain a turn down ratio of 8, the maximum charging pressure, $P_2$, would have to be 8,000 to 12,000 psi higher than the closing pressure. This is quite demanding of a jerk pump. In addition, raising the closing pressure of the accumulator nozzle aggravates the turn down ratio problem. In accumulator nozzles raising the closing pressure raises the opening pressure even more. The larger difference in these pressures would force extremely high maximum charging pressures at full delivery to obtain a reasonable turn down ratio. Such higher pressures would require extra expense, reduced life of the hydraulic equipment, and wasted power.

SUMMARY OF THE INVENTION

The present invention affords, for the first time, a practical, economical solution to the problem that has long confronted those working in the art and that has heretofore prevented the adoption and use of accumulator nozzles in diesel engine fuel injection systems even though, as noted, such usage would otherwise be quite advantageous in assisting to control the formation of the so-called incomplete combustion class of pollutants. This solution is relatively simple, straightforward and inexpensive as compared to other proposed solutions that require high pressures, complex expensive systems and system components.

Specifically, the present invention permits accumulator nozzles of the present invention to be used in jerk pump diesel engine fuel injection systems and to achieve high turn down ratios, that is, in excess of ten, while having their opening pressures close to their closing pressures and without requiring excessively high maximum charging pressure. The improved accumulator nozzle of the present invention includes a displacement piston that is adapted to lower the pressure of the fuel in the nozzle's accumulator chamber by a preselected amount after the nozzle needle valve is first opened so as to permit fuel to be injected through the orifices. Alternatively, the improved accumulator nozzle includes a piston moveable in response to the difference in the fuel pressures in the accumulator chamber and the chamber which controls the opening of the nozzle needle valve, with this moveable piston being adapted to raise the closing pressure of the accumulator nozzle a preselected amount after the nozzle needle valve is first opened so as to permit fuel to be injected through the orifices.

Accordingly, it is a principal object of the present invention to provide an improved fuel injection system for a diesel internal combustion engine where the system utilizes improved accumulator nozzles that are able to achieve high turn down ratios. A related object of the present invention is to provide an improved diesel engine fuel injection system of the type described where the improved accumulator nozzles utilized in that system have their opening pressures close to their closing pressures so as to provide a high turn down ratio without requiring an excessive maximum charging pressures.

Another object of the present invention is to provide an improved diesel engine fuel injection system of the type described where the improved accumulator nozzles utilized with that system each includes a displacement piston which serves to lower the charge pressure by preselected amount after the injection of fuel commences. A related object of the present invention is to provide an improved diesel engine fuel injection system of the type described where alternatively, each of the improved accumulator nozzles utilized with that system includes a small, moveable piston that raises the closing pressure after the injection of fuel commences.

Still another object of the present invention is to provide an improved diesel engine fuel injection system of the type described where the system includes a source of diesel engine fuel; a pump for pumping fuel under pressure to each of the diesel engine cylinders; a plurality of injection lines, one for each of the diesel engine cylinders, a plurality of improved accumulator nozzles, one for each of the diesel engine cylinders, with one of the injection lines providing a fluid connection between the outlet of the pump and the inlet of one of the accumulator nozzles and with each of the accumulator nozzles including novel structure that permits the accumulator nozzles to have their opening pressures close to their closing pressures so as to achieve high turn down ratios without having an excessive maximum charging pressures; a sump for receiving fuel from each of the spill lines of the accumulator nozzles, including a regulator for imposing a back pressure on each of the spill lines, which back pressure is low under engine cranking conditions and is high under engine operating conditions; a plurality of secondary valves, one disposed in each of the injection lines, with each secondary valve being selectively operable to provide a fluid connection between an outlet of the pump and the inlet of the accumulator nozzle or to place the spill line of the accumulator nozzle in fluid connection with the pressure regulated sump; and a controller for selectively moving the secondary valves between their two positions so that the accumulator nozzles will have low opening pressures during engine cracking and will have high closing pressures under normal operating conditions.

A related object of the present invention is to provide an improved diesel engine fuel injection system of the type described where the pump includes a plurality of pumping elements, one for each of the diesel engine cylinders. A further related object is to provide an improved diesel engine fuel injection system of the type described where a displacement piston is disposed in each of the accumulator nozzles and in fluid communication with the accumulator chamber, with the displacement piston being adapted to lower the charge pressure of the accumulator chamber of its accumulator nozzle by a preselected amount after the accumulator nozzle has commenced injecting fuel under pressure through its orifices. Still another related object of the present invention is to provide an improved diesel engine fuel injection system of the type described where alternatively, a piston is movable in response to the difference in the fuel pressures in the accumulator chamber and in the chamber that serves to bias the nozzle needle valve of the accumulator nozzle to its closed position, with the movable piston being adapted to raise the closing pressure of the accumulator nozzle after the nozzle needle valve is moved to the position whereby the injection of fuel through the orifices of the accumulator nozzles commences.

Yet another object of the present invention is to provide an improved accumulator nozzle for use in a diesel engine fuel injection system of the type described where the improved accumulator nozzle includes novel structure for permitting the opening pressure of the accumulator nozzle to be close to its closing pressure so as to provide a high turn down ratio without having an excessive maximum charging pressure. A related object of the present invention is to provide an improved accumulator nozzle of the type described where the accumulator nozzle includes a displacement piston disposed in fluid connection with the accumulator chamber of the accumulator nozzle, with the displacement piston being adapted to lower the charge pressure of the accumulator chamber by a preselected amount after the accumulator nozzle has commenced injecting fuel through its orifices. Another related object of the present invention is to provide an improved accumulator nozzle of the type described where the accumulator nozzle includes, alternatively, a piston movable in response to the differences in the fuel pressures in the accumulator chamber and the chamber that serves to bias the nozzle needle valve to its closed position, with the movable piston being adapted to raise the closing pressure of the accumulator nozzle by a preselected amount after the accumulator nozzle has begun injecting fuel through the orifices of the accumulator nozzle.

These and other objects, advantages and aspects of the present invention will be more fully understood with reference to the following description of the preferred embodiments of the present invention, as described in conjunction with the accompanying drawings.

DESCRIPTION OF THE PREFERRED EMBODIMENTS

Figure 1:
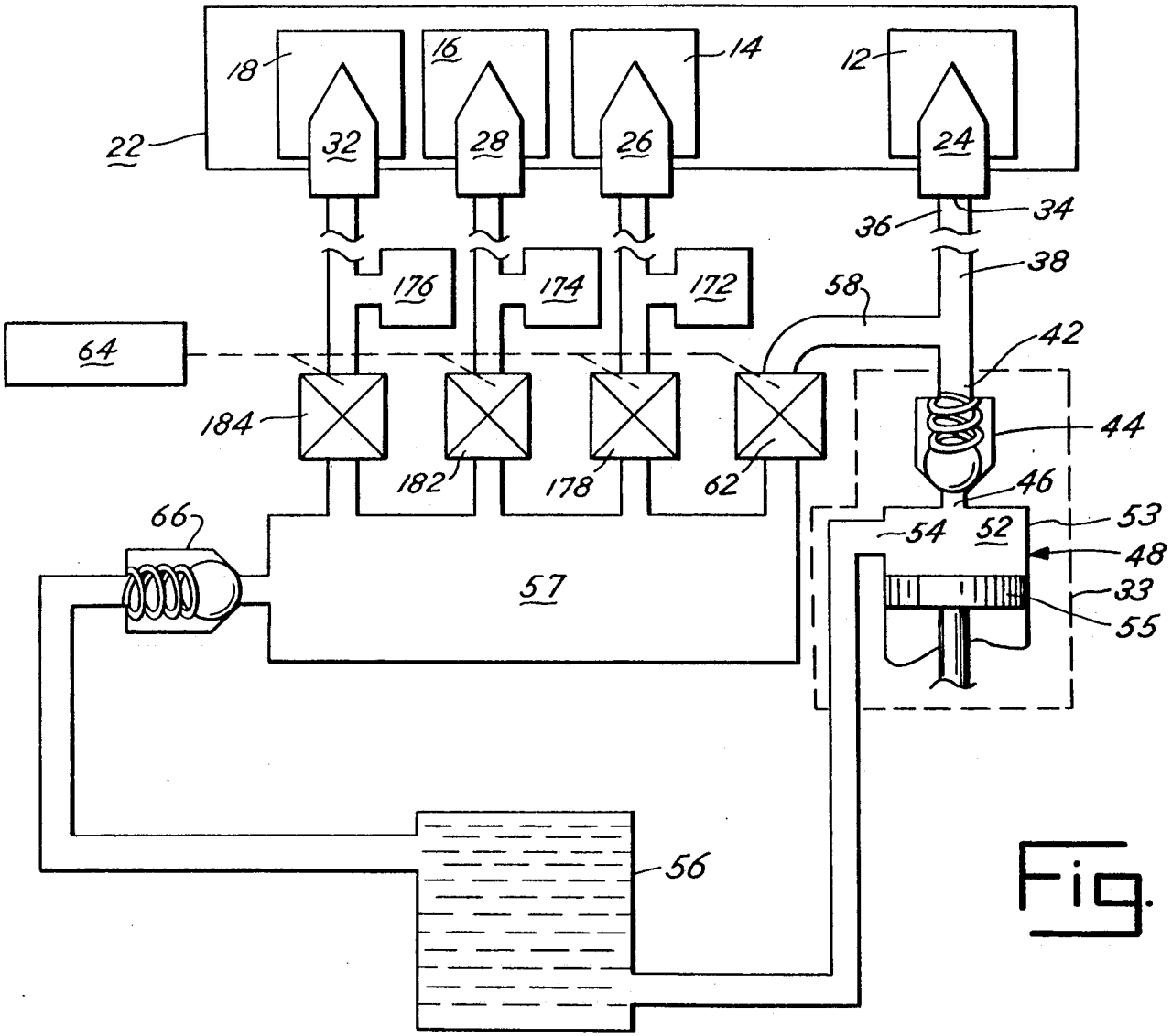
FIG. 1 shows, schematically, the improved diesel engine fuel injection system of the present invention.

The improved fuel injection system of the present invention is for use with a conventional diesel internal combustion engine, as for example, one having four cylinders. Referring now to FIG. 1, four cylinders 12, 14, 16 and 18 of such an engine is shown, partially and schematically, at 22.

Accumulator nozzles 24, 26, 28 and 32 are mounted in and operatively associated with the engine cylinders 12, 14, 16 and 18, respectively, so that the accumulator nozzles may inject diesel fuel into its associated engine cylinder. Each of the accumulator nozzles 24, 26, 28 and 32, and the subassembly that cooperate with the accumulator nozzle to accomplish the desired injection of fuel therefrom, are functionally and structurally identical. Accordingly, only one accumulator nozzle, nozzle 24, and its subassembly 33, will be described therein, it being understood that the nozzles 26, 28 and 32 and their individual subassemblies, are the same except as hereinafter specifically noted.

The inlet 34 of the accumulator nozzle 24 is in fluid connection with the downstream end 36 of an injection line 38. The upstream end 42 of the injection line 38 is in fluid connection with a conventional check valve 44 as, for example, a coil spring biased ball check valve. The check valve is, in turn, in fluid connection with the outlet or discharge port 46 of a conventional jerk pump 48.

The pump 48 includes four pumping elements or chambers, one for each of the nozzles 24, 26, 28 and 32. A chamber 54 is associated with the nozzle 24 and includes a cylinder wall 53 having at least one inlet or fill port 54 in the chamber wall through which fuel may be drawn into the pumping chamber 52 of the jerk pump. The chamber 52 also has at least one spill port, now shown, although one port may serve both the fuel "fill" and "spill" function as is covered and uncovered by a plunger or piston 55 that reciprocally moves in the chamber in a conventional manner. The metering system in a jerk pump may use a land on the plunger 55 to cover and uncover the fill and spill ports. Usually the two ports are slightly displaced from each other. The effective length of the land on the plunger determines the quantity of fuel pumped. The plunger may include a helical cut along its surface such that in different angular orientations, the length of the exposed land is different. By controlling the orientation, metering of fuel quantity is effected. Such a metering system is described on page 23, and especially of FIG. 32 of Burman's book.

A conventional fuel gallery 56 serves as a supply of filtered diesel engine fuel, under a pressure of around 50 psi, for the chamber 52 of the jerk pump 48. The gallery 56 may also serve as the common fuel supply for the other pumping elements associated with the nozzles 24, 26, 28 and 32.

Fuel in or in fluid connection with the injection line 38 may be dumped into a sump 57 that may be used in common by the subassemblies of the other accumulator nozzles 26, 28 and 30. A branch or secondary line 58 interconnects the injection line 38 with the sump 57. A secondary or dump valve 62 is disposed within this secondary line 58 and is of a conventional structure and function. Specifically, the secondary valve 62 may be moved between a first position where fuel under pressure from the jerk pump 48 passes through the check valve 44, the injection line 38, and into the inlet 34 of the accumulator nozzle 24 and second position where the injection line 38 is in fluid connection with the sump 57 so that fuel in that injection line, as well as the fuel in the secondary line 58 and those parts of the accumulator nozzle 24 which are in fluid connection with the interior of the injection line 38, may flow into the sump.

A controller 64 selectively controls the operation of the secondary valve 62—and additionally the secondary valves that are a part of the subassemblies of the other accumulator nozzles 26, 28 and 32—so that it will be moved between its first to second position to promote proper timing and operation of the engine 22 in accordance with conventional engine operation techniques. This controller 64 may be a simple mechanical device, or it may be a sophisticated electronic digital device such as, for example, the Model EEC IV marketed by the Electrical & Electronics Division of the Ford Motor Company. The latter is a microprocessor based device that is capable of receiving signals from sensors sensing engine speed and angular position of the pistons, of determining the precise time a given nozzle should be fired and of sending signals to solenoid valves. Specifically, the operation of the valve 62 is controlled so that fuel is injected through the accumulator nozzle 24 into the engine cylinder 12 at the proper time before the engine piston reaches its top dead center so as to minimize the formation of NOx pollutants while promoting the efficient and economical operation of the engine 22.

A conventional back pressure regulator 66 is in fluid connection with the sump 57 and controls the pressure of the sump and of the fuel passing into the sump through the secondary line 58 and the injection line 38. The use of the regulator 66 permits the accumulator nozzle to have a low opening pressure while the engine 22 is being cranked, and to have a high closing pressure under normal engine operating conditions.

Figure 2:
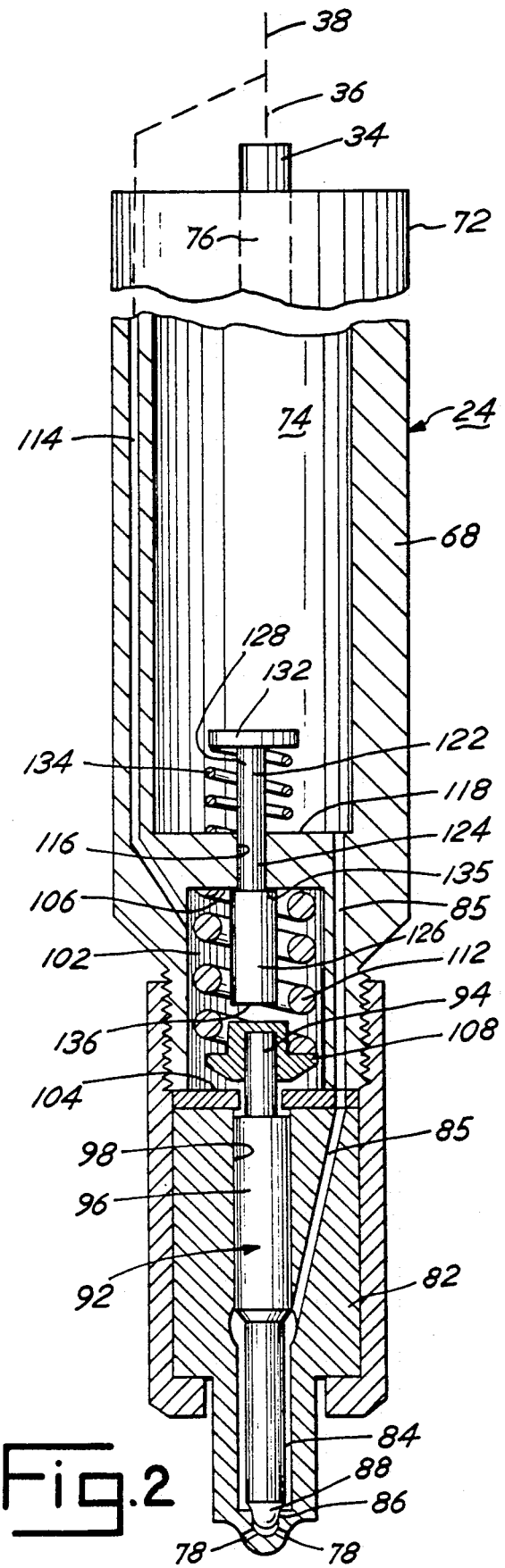
FIG. 2 is a partial, cross-sectional view of a first embodiment of the improved accumulator nozzle of the present invention.

The structure of the first preferred embodiment of the accumulator nozzle 24—and thus the accumulator nozzles 26, 28 and 32—is best illustrated in FIG. 2. As noted above, the embodiment of the accumulator nozzle 24 shown in FIG. 2 is one of two of the preferred embodiments of the improved accumulator nozzle of the present invention.

More specifically and with reference with FIG. 2, accumulator nozzle 24 includes a body 68 that has an inlet 34 at one end 72. As noted above, the inlet 34 is in fluid connection with the downstream end 36 of the injection line 38. The inlet 34 permits fuel under pressure to flow from the injection line 38 into a accumulator chamber 74. A check valve 76 is located downstream from the inlet 34 and prevents fuel from flowing from the accumulator chamber 74 back into the injection line 38.

A plurality of small orifices 78 are formed in the other end 82 of the accumulator nozzle 24. They are of conventional design and arrangement. The other end 82 is adapted to project into the interior of the diesel engine cylinder 12 and the orifices 78 are used inject or spray drops of fuel into the interior of the engine cylinder 22 for combustion therein in a conventional manner.

A second chamber 84 is formed within the other end 82 immediately upstream from the orifices 78. A fluid passage 85 provides a fluid connection between the accumulator chamber 74 and the second chamber 84 so that in all material respects, the pressure of the fuel in the accumulator chamber 74 and the pressure of the fuel in the second chamber 84 are the same.

An annular valve seat 86 is formed in the end of the second chamber 84 adjacent to the orifices 78. A first valving end 88 of a nozzle needle valve 92 is adapted to be seated in this seat 86 and when seated, to block or prevent the flow of fuel through the orifices 78. Specifically, the first end 88 of the nozzle needle valve 92 is shaped so that when it is seated in the valve seat 86, flow of fuel through the nozzles or orifices 78 is prevented.

The nozzle needle valve 92 is generally cylindrical in shape and the diameter of the first end 88 is less than the diameter of the central portion 96 which is adapted to specifically move within the bore 98 in the other end 82. The tolerances between the bore 98 and the central portion 96 are such that to prevent leakage of fuel therebetween. The fuel under pressure in the second chamber 84 acts on the nozzle needle valve, in particularly, the larger diameter central portion 96 thereof to bias or urge the valve 92 away from the position wherein its first end 88 is seated in the seat 86.

A third chamber 102 is formed in the body 68 between the accumulator chamber 74 and the second chamber 84. This third chamber is generally cylindrical in shape and has a first end 104 and a second end 106. There is no fluid connection between the third chamber 102 and either of the other chambers 74 and 84, although the bore 98 communicates with the chamber 102 and the second end 94 of the nozzle needle valve 92 extends into that chamber even when first end 88 is seated on the seat 86.

A spring retainer 108 is mounted on the second end 94 of the nozzle needle valve and receives one end of a coil compression spring 112. The other end of the coil compression spring 112 abuts the second end 106 of the chamber 102. The spring force of the coil compression spring 112 is selected so that spring will bias the nozzle needle valve 92 toward the position wherein its first end 88 is seated against the seat 86 whenever the fuel pressure in the second chamber 84 drops below the closing pressure.

A spill passage 114 is formed in the body 68, and extends from the third chamber 102. It provides a fluid connection between that chamber 102 and the injection line 38, at a point upstream from the check valve 76.

A bore 116 extends between the second end 106 of the third chamber 102 and the end 118 of the accumulator chamber 74. A moveable piston 122 is adapted to reciprocally move within the bore 116. The piston includes a central portion 124 that is disposed within this bore 116, a first end 126 and a second end 128. The dimensions and tolerances of the central portion 124 and the bore 116 are selected so that there is no fluid connection between the chambers 74 and 102. The first end 126 of the piston 122 is disposed Within the third chamber 102 while the second end 128 of the piston 122 is disposed within the chamber 74. The first end 126 has a larger diameter than the central portion 124, and the second end 128 terminates in an enlarged portion 132 which serves as a spring retainer. A coil compression spring 134 extends between the retainer 132 and the end 118 of the chamber 74 and serves to bias the retainer 132, and thus the piston 122, away from the end 118.

As noted, the piston 122 is axially moveable within the bore 116 and is coaxial with the nozzle needle valve 92. When the moveable piston 122 is a first position, the proximal portion 135 of the first end 126 abuts the end 106 of the chamber 102 and the distal portion 136 is spaced from the second end 94, including the retainer cap 108, of the nozzle needle valve 92. When the moveable piston 122 is moved to a second position, due to the existence of a pressure differential between the chambers 74 and 102, the distal portion 136 of the first end 126 of the piston 122 abuts the second end 94 of the nozzle needle valve 92 and exerts a force thereon proportional to the pressure differential (minus, of course, the force exerted by the spring 134). The spring 112, as well as the differences in the diameters of the first end 126 and the second end 128, are selected so that the force of the spring 112, as well as the force exerted by the moveable piston 122, will urge or bias the nozzle needle valve 92 to the position shown in FIG. 2 (where the first end 88 of the valve is seated in the seat 86) whenever the fuel pressure in the accumulator chamber 74 exceeds the fuel pressure in the third chamber 102 by a preselected amount.

The embodiment of the accumulator nozzle 24 illustrated in FIG. 2 and described hereinabove functions in a conventional manner except as hereinafter noted. Specifically, during engine operation, the chamber 52 of the jerk pump 48 pumps fuel under pressure to the accumulator nozzle 24 through the injection line 38 while the valve 62 is in a position blocking a fluid connection between that injection line 38 and the sump 57. Fuel under pressure is introduced into the accumulator chamber 74 through the inlet 34 and the check valve 76. Fuel under pressure also is introduced into the second and third chambers 84 and 102 through the passages 85 and 114, respectively. Because the pressures in the chamber 74, 84 and 102 are identical, the first end 88 of the nozzle needle valve 92 is and remains seated, under the bias of the spring 112, in the seat 86 thereby preventing the flow of fuel through the orifices 78. Similarly, the moveable piston 122 remains in its first position under the bias of the spring 134 so that the proximal end 135 of the first end 126 abuts the end 106 of the third chamber.

Under the continued pumping action of the pumping element of the pump 48, the pressure in the chambers 74, 84 and 102 continues to increase. When the piston 55 reaches its spill port, the pumping action ceases, the pressure in the chamber 52 decreases, and the check valve 44 isolates the injection line 38 from the chamber 52. The controller 64 then actuates the secondary valve 62 so that that valve is positioned whereby fluid communication occurs between the injection line 38 and the sump 57. (The valve 62 may be actuated at or after the end of the pumping stroke of the pump 48.) When the valve 62 is actuated, the accumulator nozzle 24 will "fire", that is, will permit the injection of fuel into the cylinder 12; provided, of course, that the pressure in the chambers 74 and 84 are above the opening pressure of the nozzle 24. (This opening pressure is determined by the spring force of the spring 112, together with the pressure if any remaining in the third chamber 102 which, as noted above, is in fluid communication with the injection line 38, the secondary line 58 and thus the sump 57.) The opening pressure may be raised in accordance with the back pressure imposed upon this chamber 102 by the back pressure regulator 66.

Assuming, however, that the charging pressure in the accumulator chamber 74 is above the opening pressure of the nozzle 24, the nozzle needle valve 92 will be moved away from the seat 86 due to the pressure of the fuel in the second chamber 84. The amount of fuel injected by the accumulator nozzle 24 is determined by the difference between the charging pressure and the closing pressure. The minimum quality of fuel injected is obtained when the charging pressure is just enough to open the nozzle 24. The maximum injected quantity is obtained when the charge pressure is at its maximum value. As noted above, this maximum injected quantity or delivery is proportional to the difference between the maximum charging pressure and the closing pressure. Likewise, the minimum delivery is proportional to the difference between the opening pressure and the closing pressure.

The opening pressure in a conventional accumulator nozzle is substantially higher (more than 1,000 psi) than its closing pressure because the injection fuel presses on a smaller area to open the nozzle than it does to hold it open. In order to obtain an adequate turn down ratio in such a conventional nozzle, it was necessary that the difference between the maximum charging pressure and the closing pressure be several times, perhaps eight, the difference between the opening and closing pressures. This requirement led to excessive or very high, e.g., 15,000 to 20,000 psi, maximum charging pressures. Such excessive maximum charging pressures required extra expense, reduced the life of the hydraulic equipment, and wasted power.

The embodiment of the present invention, described in connection with FIG. 2, solves this problem by raising the closing pressure to be close to the opening pressure. Specifically, the moveable piston 122 is moved, as a result of the differential in the pressures in the chambers 74 and 102 after the nozzle 24 has been fired, so that its distal portion 136 abuts and presses on the end 94 of the nozzle needle valve 92 immediately after the nozzle needle valve starts to open. This abutment tends to increase the closing pressure by a preselected amount. The diameter of the moveable piston may be selected to make this increase in the closing pressure as large as desired. With this increase in the closing pressure, the minimum fuel quantity injected may be very small. Accordingly, the turn down ratio can be very large with even modest maximum charging pressures.

Moreover, because the pressure in the third chamber 102 "holds" both the nozzle needle valve 92 and the moveable piston 122 in their "rest" positions, they both start to move when the pressure in the chamber 102 is reduced at the start of the injection cycle. Contact between the piston 122 and the nozzle needle valve 92 occurs after both have begun to move. If the closing pressure, after this contact, is higher than the accumulator pressure, that is, the pressure in the chambers 74 and 84, the nozzle needle valve 92 will be quickly moved back to its seated or closed position and after only a very small quantity of fuel has been injected through the orifices 78.

The embodiment of the accumulator nozzle illustrated in FIG. 3 and described hereinbelow has a structure and function generally similar to that of the embodiment of the nozzle 24 shown in FIG. 2. Accordingly, only the structural differences will be specifically described herein, and the same reference numerals will be used in FIG. 3 for the components of the accumulator nozzle 24 that are common with those in the FIG. 2 embodiment.

Figure 3:
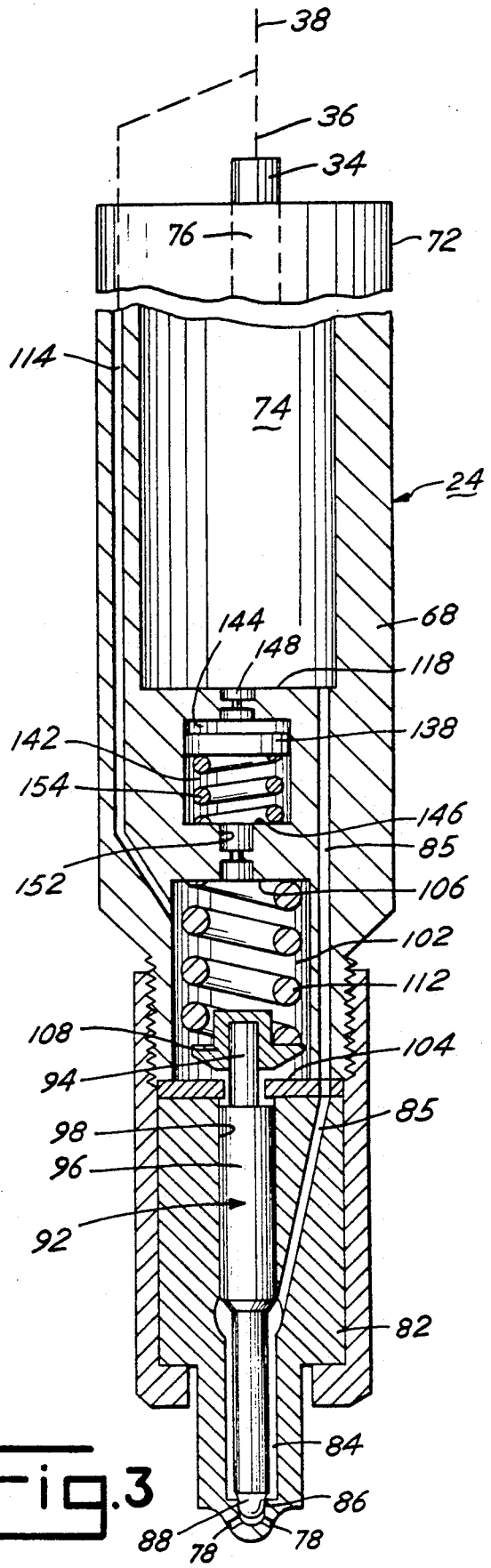
FIG. 3 is a partial cross-sectional view of a second embodiment of the improved accumulator nozzle of the present invention.

The principal difference between the FIG. 2 and FIG. 3 embodiments is that the moveable piston 122 is replaced in the latter by a cylindrical displacement piston 138. That piston is disposed in a fourth chamber 142 formed in the body 68 of the accumulator nozzle 24. This chamber 142 is cylindrical and has a first end 144 and a second end 146. A restricted passage 148 provides a restricted fluid connection between the first end 144 of the chamber 142 and the accumulator chamber 74 while a restricted passage 152 provides a restricted fluid connection between the end 146 of the chamber 142 and the third chamber 102. Although both passages 148 and 152 are shown as being restricted, the FIG. 3 embodiment will function with only one of the passages being restricted.

The displacement piston 138 is moveable in the fourth chamber 142 between its first and second ends 144 and 146. The dimensions and tolerances betWeen the radial outer surface of the piston 138 and the cylindrical side wall of the cylindrical chamber 142 are such that there is no fluid connection around the piston 138.

A coil compression 154 is disposed within the fourth chamber 142 between the piston 138 and the end 146 of that chamber. This spring serves to bias the piston 138 to position adjacent to the end 144 of the chamber 142.

As before, when the injection cycle of the accumulator nozzle 42 begins, that is, when the valve 62 is moved, under the control of the controller 64, to a position whereby the injection line 38 and the third chamber 102 are vented to the sump 57, the pressure differential between the accumulator chamber 74 and the third chamber 102 is such that the piston 138 moves away from its "rest" position (that is, its position adjacent the end 144 of the chamber 142) toward the end 146 of the chamber.

As before, the amount of fuel injected by the accumulator nozzle 24 is determined by the difference between the charging pressure and the closing pressure. The minimum quantity of fuel injected is obtained when the charging pressure is just enough to open the nozzle. The maximum injected quantity is obtained when the charging pressure is at its maximum value.

In order to obtain a satisfactory turn down ratio in prior accumulator nozzles, it was heretofore necessary to employ excessively large charging pressure. Such higher charging pressures presented a serious problem and required extra expense, reduced the life of the hydraulic equipment, and wasted power.

The inclusion of the displacement piston 138 overcomes this long standing problem. This relatively small displacement piston 138 drops the pressure of the fuel stored in the accumulator chamber 74, immediately after the nozzle needle valve 92 starts to open, by a preselected amount that may be nearly as large as the difference between the opening and closing pressure when the maximum charging pressure is at or close to the opening pressure. With this preselected pressure drop, the minimum fuel quantity injected into the engine cylinder 12 may be very small. Since the displacement piston 138, however, discards only the same small quantity of fuel at all times, it does not subtract all that much fuel from an injection when the maximum charging pressure exists in the chamber 74 at the time an injection cycle commences. Accordingly, the turn down ratio of the nozzle 24 may be very large.

It should also be particularly noted that the displacement piston 138 (specifically, the portion of the chamber 142 between the piston 138 and the end 144) communicates with the accumulator chamber 74 through the restricted passage 148. Thus, when the pressure in the chamber 102 is reduced (at the time the nozzle 24 is "fired") and when the nozzle needle valve 92 begins to open, the displacement piston 138 moves as well. Although because of the restriction in the passage 148, the piston 138 does not complete its motion until after the nozzle needle valve 92 is partway open as, for example, ten percent of its stroke. If the pressure in the accumulator chamber 74 has dropped, by that time, below the closing pressure, the needle valve 92 will reverse its direction and close the orifices 78 with only a small quantity of fuel having been injected. On the other hand, if the fuel pressure of charging pressure in the accumulator chamber 74 remains high, the injection will proceed normally except for the small quantity of fuel discarded by the opening movement of the displacement piston 138.

Figure 4:
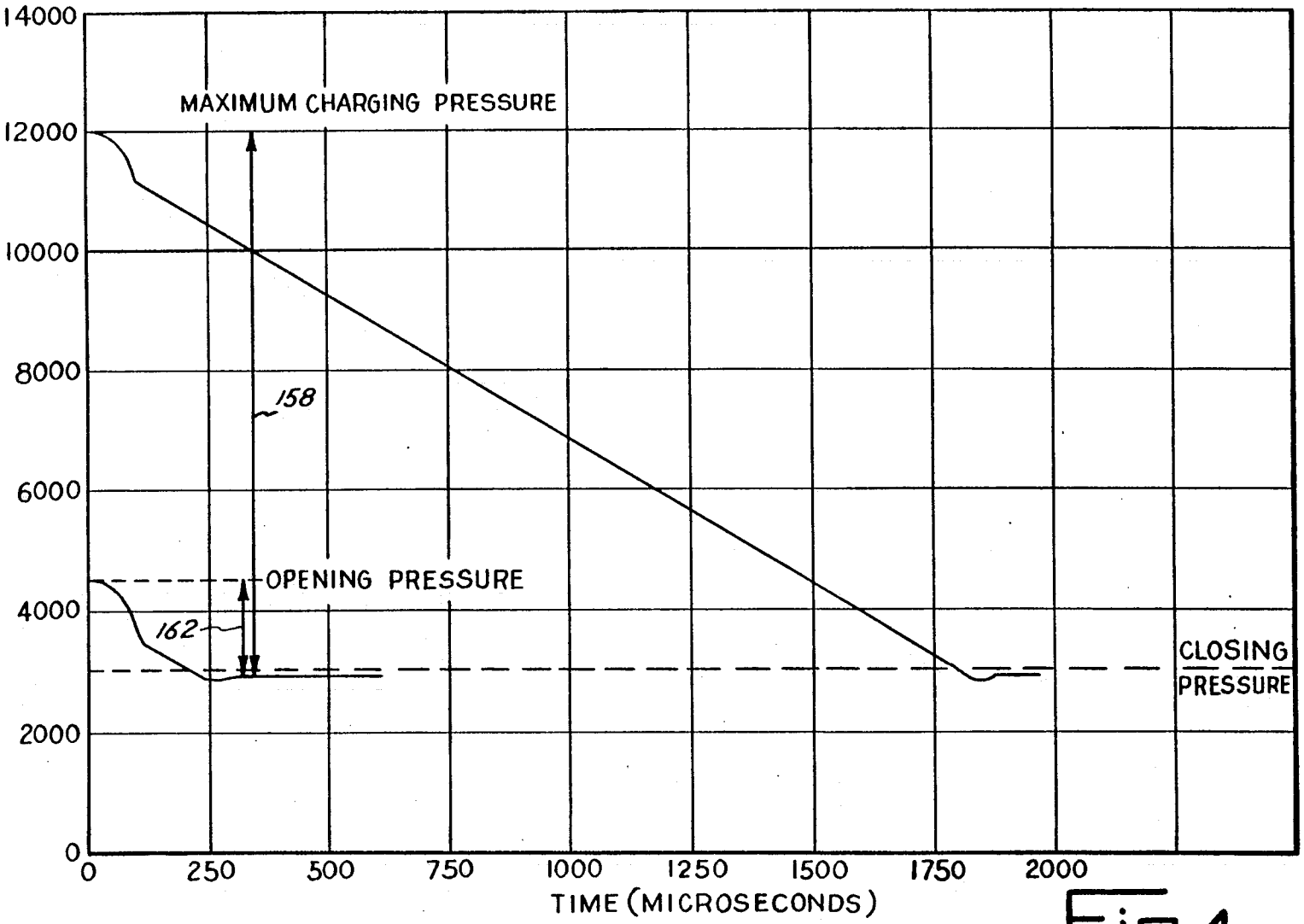
FIG. 4 is a graph of accumulator pressure versus time and represents how the pressure of the fuel in a conventional accumulator nozzle would change during the fuel injection cycle of that accumulator nozzle.

Referring now to FIG. 4, this graph illustrates how the fuel pressure changes over time where fuel injection occurs under maximum charging pressures and where the charging pressure is very close to the opening pressure. The arrow, identified by the reference number 158, indicates the pressure differential between the maximum charging pressure and the closing pressure while the arrow identified by the reference number 162, indicates the pressure differential between the opening and closing pressures. As illustrated in this FIG. 4 graph, which as noted above shows what would occur in a prior art accumulator nozzle, a turn down ratio of the order of 5.3 would be achieved.

Figure 5:
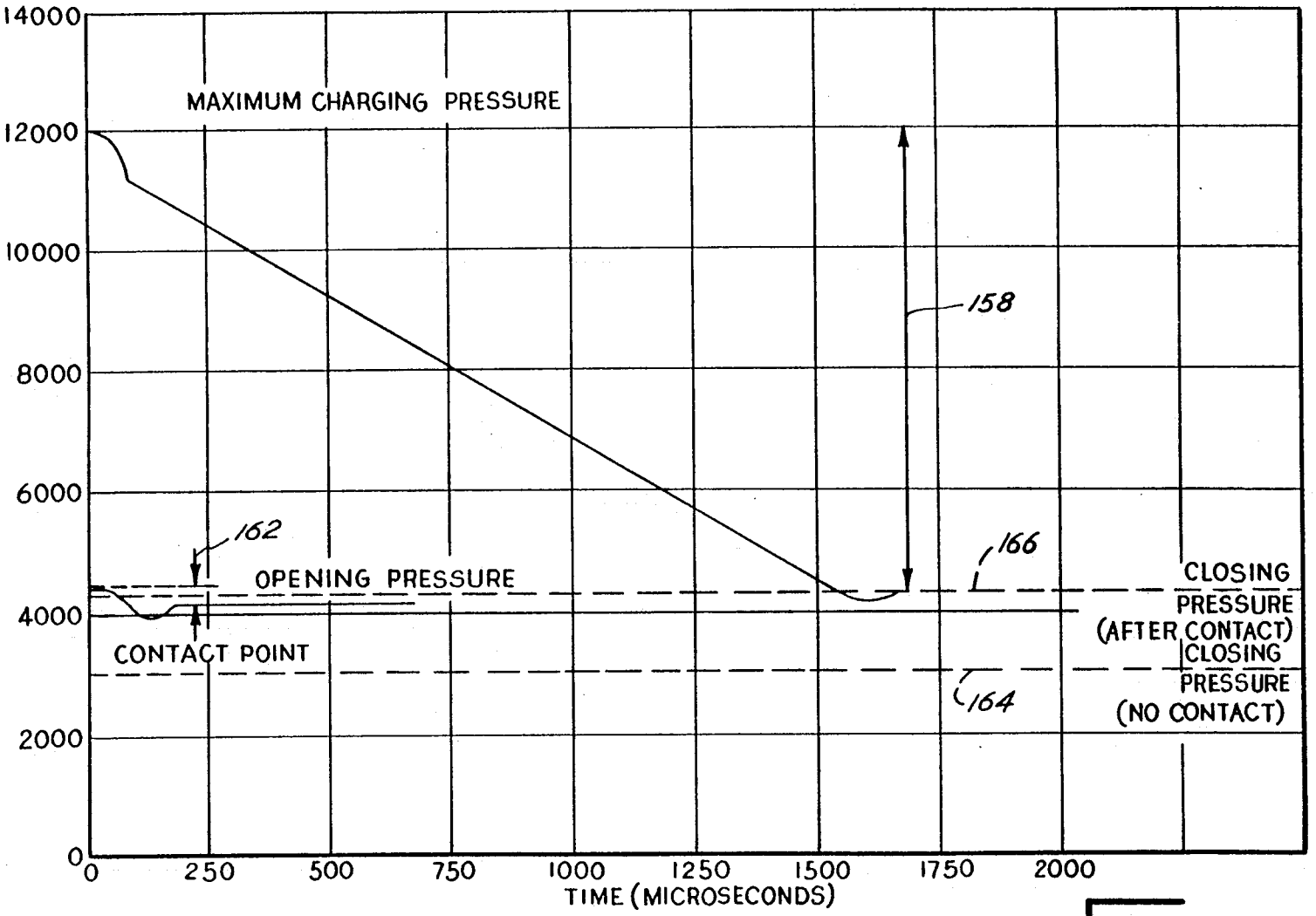
FIG. 5 is a graph similar to that of FIG. 4 and represents how the pressure of the fuel in a accumulator nozzle of FIG. 2 would change during the fuel injection cycle of that accumulator nozzle.

FIG. 5 discloses a similar fuel pressure vs. time relationship as that shown in FIG. 4. This illustrated relationship would occur when the accumulator nozzle 24 includes the moveable piston. It demonstrates the effect of that piston on the closing pressure. The reference number 164 indicates the closing pressure if there were no contact between the piston 122 and the nozzle needle valve 92. The reference number 166 indicates the increased closing pressure that would exist after the piston 122 abuts the end 94 of the nozzle needle valve 92. In this embodiment of the nozzle 24, the turn down ratio (calculated in a similar manner to that used in calculating the turn down ratio in the FIG. 4 nozzle) would be of the order of 25.7.

Figure 6:
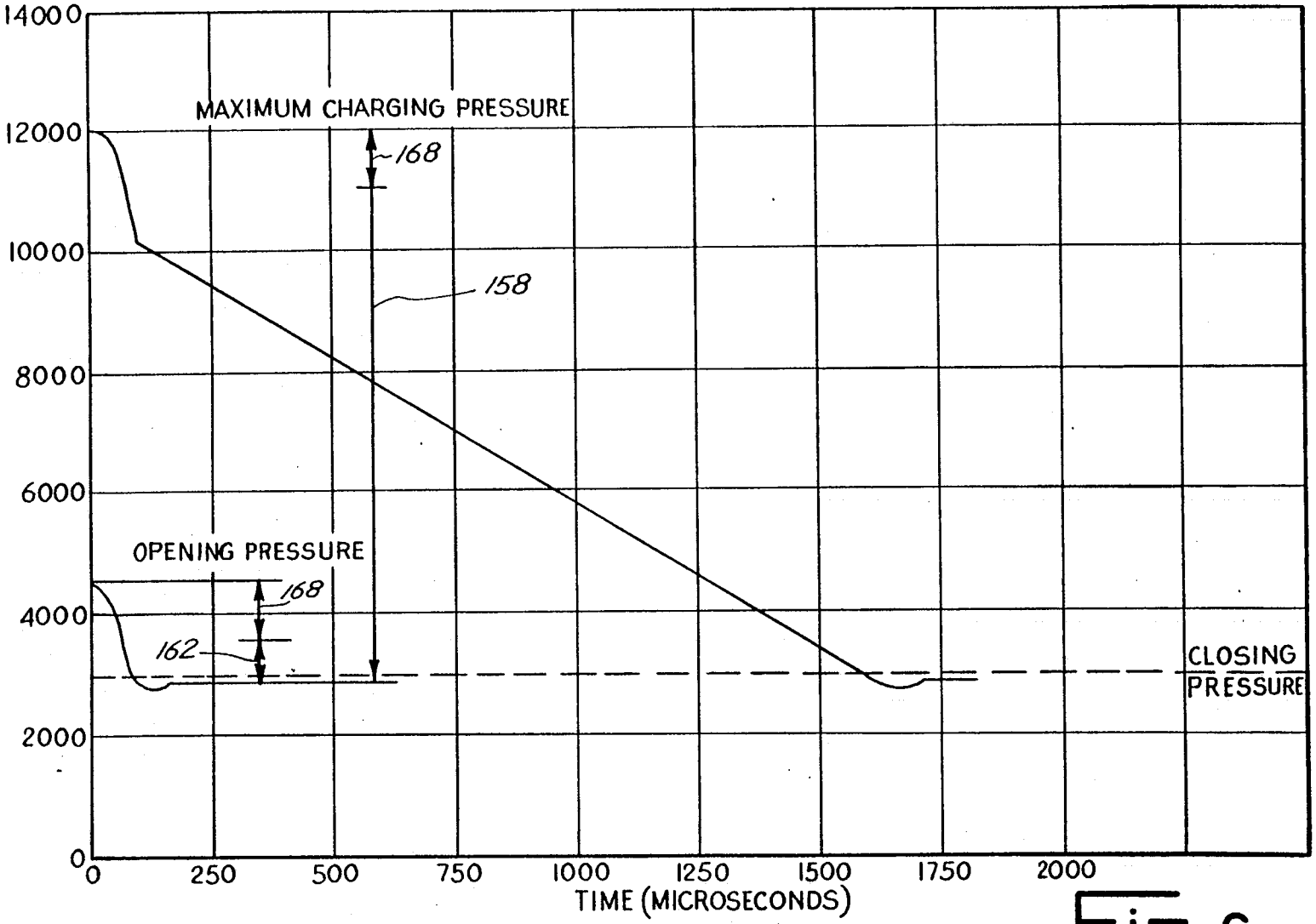
FIG. 6 is a graph similar to FIGS. 4 and 5 and represents how the pressure of the fuel in an accumulator nozzle of FIG. 3 would change during the fuel injection cycle of that accumulator nozzle.

FIG. 6 shows a comparable fuel pressure vs. time relationship to that illustrated in FIGS. 4 and 5. The relationship, it is believed, would occur when the accumulator nozzle 24 includes a displacement piston 138. The reference number 168 indicates the amount of the pressure drop that occurs through the use of the displacement piston 138. Again, the turn down ratio, similarly calculated, would be of the order of 11.7.

Thus, it is apparent from FIGS. 4–6 that substantial increases in the turn down ratio may be achieved by the inclusion of either a movable piston 122, or alternatively, a displacement piston 138 in an accumulator nozzle 24. These increases in the turn down ratio make practical and feasible the use of accumulator nozzles, with all their known benefits, in a diesel engine fuel injection system. The usage of such improved accumulator nozzles should enable such systems to substantially reduce pollution caused by incomplete combustion.

The accumulator nozzle 24 and its subassembly 33 have been described in detail. As noted above, similar accumulator nozzles 26, 28 and 32 would be used with their associated engine cylinders 14, 16, 18, respectively. Moreover, the subassemblies 172, 174 and 176 of the nozzles 26, 28 and 32, respectively, are likewise identical in structure and function to the subassembly 33 (and its above described components). Also secondary valves 178, 182 and 184 are utilized with the nozzles 26, 28 and 32, and their associated subassemblies 172, 174 and 176, respectively. These valves 178, 182 and 184 are structurally and functionally identical to the valve 62, and like the valve 62, are controlled by the controller 64.

The preferred embodiments of the present invention have now been described. These preferred embodiments constitute the best mode contemplated by the inventor for carrying out his invention. Because his invention may be copied, without copying the precise details of the preferred embodiments, the following claims particularly point out and distinctly claim the subject matter which the inventor regards as his invention and wishes to protect.

What is claimed is:

1. An improved fuel injection system for a diesel internal combustion engine having a plurality of cylinders and adapted to be operated so as to control the formation of oxides of nitrogen as well as smoke, particulates, carbon dioxide and odor that may be caused by incomplete combustion, the improved system comprising:

a source of fuel for the diesel engine;

means for pumping fuel under pressure to each cylinder of the diesel engine, the pumping means including a plurality of fuel inlets in fluid connection with the source of fuel and a plurality of fuel outlets for permitting the flow of pressurized fuel from the pump means with there being a fuel inlet and fuel outlet for each of the cylinders of the diesel engine;

a plurality of injection lines, one for each fuel outlet of the pump means, with each injection line having a first end in fluid communication with one of the fuel outlets of the pump means and a second end;

a plurality of accumulator nozzles, one for each one of the cylinders of the diesel engine, with each accumulator nozzle having an opening pressure, a closing pressure, and a charging pressure and also having at least one orifice through which fuel under pressure may be injected, with each one of the accumulator nozzles being operatively associated with one cylinder of the diesel engine so that fuel under pressure may be injected through the orifice of the associated accumulator nozzle into that cylinder and with each accumulator nozzle also including: an inlet that is in fluid connection with the second end of the one injection line; an accumulator chamber in fluid connection with the inlet; a check valve for permitting the flow of fuel under pressure from the one injection line, through the inlet and to the accumulator chamber; a nozzle needle valve having a first end and a second end that is adapted to be moved between a first position wherein fuel may flow through the orifice and a second position wherein the first end of the nozzle needle valve prevents the flow of fuel through the orifice; a second chamber that is adjacent to the second end of the nozzle needle valve and the orifice and that is in fluid connection with the accumulator chamber, with the second end of the nozzle needle valve including a surface area that is subject to the pressure of the fuel in the second chamber so that the pressure of the fuel therein biases the nozzle needle valve to its first position; a third chamber adjacent to the first end of the nozzle needle valve; a spill line being in fluid connection between the third chamber and the one injection line, upstream of the accumulator nozzle check valve; means for contacting the nozzle needle valve and, together with the pressure of the fuel in the third chamber, for biasing the nozzle needle valve towards its second position; and means for permitting the opening pressure of the accumulator nozzle to be close to the closing pressure of the accumulator nozzle so as to provide a high turn down ratio without having an excessive maximum charging pressure;

means for receiving fuel from the spill lines of the accumulator nozzles including means for imposing a back pressure on the spill lines and thus the third chambers of the accumulator nozzles, which back pressure is low under engine cranking conditions and is high under engine operating conditions;

a plurality of secondary valves, one disposed in each of the injection lines, between their first and second ends and upstream from the interconnection of the injection line and its associated spill line; a plurality of secondary lines, one for each one of the secondary valves, with a secondary line providing a fluid connection between each one of the secondary valves and the fuel receiving means, and with each one of the secondary valves being selectively moveable between a first position wherein the fuel may flow through its associated injection line from the fuel outlet of the pump means to its associated accumulator nozzle and a second position wherein fuel may flow to the fuel receiving means from its associated spill line and the injection line, downstream of the one secondary valve; and means for selectively moving each of the secondary valves between their first and second positions so that the accumulator nozzles will have a low opening pressure during engine cranking and will have a high closing pressure under normal operating conditions.

2. The improved fuel injection system of claim 1 wherein the pump means includes a plurality of pumping elements, one for each one of the accumulator nozzles, with each pumping element having an inlet in fluid connection with the source of fuel, an outlet in fluid connection with the first end of one of the injection lines and a check valve for permitting the flow of pressurized fuel from the pumping element to the one injection line.

3. The improved fuel injection system of claim 2 wherein the means for providing a high turn down ratio for each accumulator nozzle includes a displacement piston disposed in each of the accumulator nozzles and in fluid connection with the accumulator chamber, with the displacement piston being adapted to lower the charging pressure of the fuel in the accumulator chamber by a preselected amount after the nozzle needle valve is moved from its second position to its first position and the injection of fuel through the orifice has commenced.

4. The improved fuel injection system of claim 3 wherein each accumulator nozzle includes a fourth chamber that has a first end and a second end; wherein the displacement piston of the accumulator nozzle is disposed in the fourth chamber and is moveable therein between the first and second ends of the fourth chamber; wherein the accumulator chamber is in fluid connection, through a first passage, with the first end of the fourth chamber; wherein the second end of the fourth chamber is in fluid connection, through a second passage, with the third chamber; wherein at least one of the first and second passages includes a restrictor; and wherein the accumulator nozzle includes second means, independent of the pressure of the fuel in the fourth chamber, for biasing the displacement piston towards the first end of the fourth chamber.

5. The improved fuel injection system of claim 4 wherein the fourth chamber is generally cylindrical; wherein the second biasing means is a coil compression spring disposed within the fourth chamber and between the displacement piston and the second end of the fourth chamber.

6. The improved fuel injection system of claim 2 wherein the means for providing a high turn down ratio for each accumulator nozzle includes a piston moveable in response to the difference in the fuel pressures in the accumulator chamber and in the third chamber, with the movable piston being adapted to raise the closing pressure of the accumulator nozzle a preselected amount after the nozzle needle valve is moved from its second position to its first position and the injection of fuel through the orifice has commenced.

7. The improved fuel injection system of claim 6 wherein the moveable piston has a first end disposed in the accumulator chamber, and includes a surface area that is subject to the pressure of the fuel in the accumulator chamber; wherein the moveable piston has a second end disposed in the third chamber and includes a surface area that is subject to the pressure of the fuel in the third chamber; wherein the moveable piston is moveable between a first position where its second end is spaced from the first end of a nozzle needle valve and a second position where its second end is in contact with the first end of the nozzle needle valve, both when the nozzle needle valve is in its first position and is in its second position, and biases the nozzle needle valve towards its second position; and wherein the accumulator nozzle includes second means, independent of the pressure of the fuel, for biasing the moveable piston to its first position.

8. The improved fuel injection system of claim 7 wherein the moveable piston and the nozzle needle valve are axially aligned; and wherein the second biasing means is a coil compression spring disposed in the accumulator chamber and in contact with the first end of the moveable piston.

9. An improved accumulator nozzle for a fuel injection system for a diesel internal combustion engine having a plurality of cylinders, with the accumulator nozzle having an opening pressure, a closing pressure and a charging pressure and with the system including: means for pumping fuel under pressure through the accumulator nozzle to the diesel engine cylinders, with the pumping means having at least one fuel inlet in fluid connection with the source of fuel and at least one fuel outlet for permitting the flow of pressurized fuel from the pump means; an injection line having a first end in fluid connection with the fuel outlet of the pump means and a second end; means for receiving fuel from the accumulator nozzle including means for imposing a back pressure on the fuel being received, which back pressure is low under diesel engine cranking conditions and is high under diesel engine operating conditions; a secondary valve disposed in the injection line between the first and second ends of the injection line; a secondary line connecting the secondary valve with the fuel receiving means; means for selectively moving the secondary valve between for a first position wherein the fuel may flow through the injection line from the fuel outlet of the pump means to the accumulator nozzle and a second position wherein the fuel may flow to the fuel receiving means from the accumulator nozzle so that the accumulator nozzle will have a low opening pressure during diesel engine cranking and will have a high closing pressure under normal operating condition of the diesel engine, the improved accumulator nozzle comprising;

an orifice through which fuel under pressure may be injected from the accumulator nozzle into diesel engine cylinder with which the accumulator nozzle is adapted to be operatively associated;

an inlet that is adapted to be in fluid connection with the second end of the injection line;

an accumulator chamber in fluid connection with the accumulator inlet;

a check valve for permitting the flow of fuel under pressure through the accumulator inlet and to the accumulator chamber;

a nozzle needle valve having a first end and a second end that is adapted to be moved between a first position wherein fuel may flow through the orifice and a second position wherein the second end of the nozzle needle valve prevents the flow of fuel through the orifice;

a second chamber that is adjacent to the second end of the nozzle needle valve and the orifice and that is in fluid connection with the accumulator chamber, with the second end of the nozzle needle valve including a surface area that is subject to the pressure of the fuel in the second chamber so that the pressure of the fuel therein biases the nozzle needle valve toward its first position;

a third chamber adjacent to the first end of the nozzle needle valve;

a spill line being in fluid connection with the third chamber and with the injection line, upstream of the accumulator check valve;

means, independent of the pressure of the fuel in the third chamber, for biasing the nozzle needle valve towards its second position;

and means for permitting the opening pressure of the accumulator nozzle to be close to the closing pressure of the accumulator nozzle so as to provide a high turn down ratio without having an excessive maximum charging pressure.

10. The improved accumulator nozzle of claim 9 wherein the pump means includes a pumping element having an inlet in fluid connection with the source of fuel, an outlet in fluid connection with the first end of the injection line, and a check valve for permitting the flow of pressurized fuel from the pumping element to the injection line.

11. The improved accumulator nozzle of claim 10 wherein the means for providing a high turn down ratio includes a displacement piston disposed in fluid connection with the accumulator chamber, with the displacement piston being adapted to lower the charging pressure of the fuel in the accumulator chamber by a preselected amount after the nozzle needle valve has been moved from its second position to its first position and the injection of fuel through the orifice has commenced.

12. The improved accumulator nozzle of claim 11 wherein the accumulator nozzle includes a fourth chamber that has a first end and a second end; wherein the displacement piston is disposed in the fourth chamber and is movable therein between the first and second ends of the fourth chamber; wherein the accumulator chamber is in fluid connection, through a first passage, with the first end of the fourth chamber; wherein the second end of the fourth chamber is in fluid connection, through a second passage, with the third chamber; wherein at lest one of the first and second passages includes a restrictor; and wherein the accumulator nozzle includes second means, independent of the pressure of the fluid in the fourth chamber, for biasing the displacement piston towards the first end of the fourth chamber.

13. The improved fuel of accumulator nozzle of claim 12 wherein the fourth chamber is generally cylindrical; and wherein the second biasing means is a coil compression spring disposed between the displacement piston and the second end of the fourth chamber.

14. The improved accumulator nozzle of claim 10 wherein the means for providing a high turn down ratio for the accumulator nozzle includes a piston moveable in response to the difference in the fuel pressures in the accumulator chamber and in the third chamber, with the movable piston being adapted to raise the closing pressure of the accumulator nozzle after the nozzle needle valve has been moved from its second position to its first position and the injection of fuel through the orifice has commenced.

15. The improved accumulator nozzle of claim 14 wherein the moveable piston has a first end disposed in the accumulator chamber and includes a surface area that is subject to the fuel pressure in the accumulator chamber; wherein the moveable piston has a second end disposed in the third chamber and includes surface area that is subject to the fuel pressure in the third chamber; wherein the moveable piston is moveable between a first position where its second end is spaced from the first end of the nozzle needle valve and a second position where its second end is in contact with the first end of the nozzle needle valve, both when the nozzle needle valve is in its first position and is in its second position, and biases the nozzle needle valve towards its second position; and wherein the accumulator nozzle includes second biasing means, independent of the pressure of the fuel, for biasing the moveable piston to its first position.

16. The improved accumulator nozzle of claim 15 wherein the moveable piston and the nozzle needle valve are axially aligned; and wherein the second biasing means is a coil compression spring disposed in the accumulator chamber and in contact with the first end of the moveable piston.

* * * * *